US005758529A

United States Patent [19]

Chhatwal

[11] Patent Number: 5,758,529

[45] Date of Patent: Jun. 2, 1998

[54] EXTERNAL MOUNTING ARCHITECTURE FOR ELECTRONIC LOCK HAVING PIVOTABLE FRONT FACE PROTECTIVE COVER

[75] Inventor: KN Singh Chhatwal, Melbourne, Fla.

[73] Assignee: Intellikey Corporation, Melbourne, Fla.

[21] Appl. No.: 733,000

[22] Filed: Oct. 16, 1996

[51] Int. Cl.[6] ..... E05B 17/14

[52] U.S. Cl. ..... 70/423; 70/455; 70/160

[58] Field of Search ..... 70/423, 455, 424, 70/425, 426, 427, 158–162

[56] References Cited

U.S. PATENT DOCUMENTS

| | | | |
|---|---|---|---|
| 1,369,506 | 2/1921 | Voight | 70/455 |
| 1,917,977 | 7/1933 | Hughes | 70/427 |
| 1,961,456 | 6/1934 | Rubner | 70/455 |
| 2,223,615 | 12/1940 | Jacobi | 70/455 |
| 2,696,100 | 12/1954 | Nehls | 70/455 |
| 2,733,831 | 2/1956 | Nehls | 70/455 |
| 3,313,136 | 4/1967 | Gulette et al. | 70/455 |
| 4,282,732 | 8/1981 | Bennett | 70/455 |
| 4,884,424 | 12/1989 | Meyer | 70/427 |
| 5,563,387 | 10/1996 | Myers et al. | 70/455 |

FOREIGN PATENT DOCUMENTS

| | | | |
|---|---|---|---|
| 0400189 | 12/1990 | European Pat. Off. | 70/423 |
| 226025 | 4/1969 | Sweden | 70/455 |
| 2194582 | 3/1988 | United Kingdom | 70/455 |

*Primary Examiner*—Darnell M. Boucher
*Attorney, Agent, or Firm*—Charles E. Wands

[57] ABSTRACT

A housing for externally mounting an electronic lock to a support structure has a conical sidewall joining front and rear faces of the housing. A cavity extending to the front and rear faces receives the electronic lock, such that a key access face of the lock coincides with the housing's front face. The rear face of the housing has an indented region to which a pivot bracket is mounted. The pivot bracket rotatably engages a pivot shaft coupled to a hinge plate of a pivotable front cover, which is spring biased against the front face of the housing. The housings's conical sidewall has a slot intersecting the indented region. The hinge plate is configured to conform with the slot and the housing sidewall, when the cover is closed against the front face of the housing. A rear end of the hinge plate is tapered so that as said hinge plate rotates about its pivot axis, it clears the structure to which the housing is mounted.

12 Claims, 3 Drawing Sheets

EXTERNAL MOUNTING ARCHITECTURE FOR ELECTRONIC LOCK HAVING PIVOTABLE FRONT FACE PROTECTIVE COVER

FIELD OF THE INVENTION

The present invention relates in general to housing structures for security access components, and is particularly directed to a new and improved external mounting architecture for an electronic lock that includes a protective cover configured to normally provide a weatherproofing closure against the front face of the lock, thereby protecting the lock against the introduction of moisture and foreign matter due.

BACKGROUND OF THE INVENTION

As more and more security access control installations are upgraded or replace mechanical hardware with electronically based equipment and components, protecting such components against potentially degrading environmental conditions, including weather and the introduction of moisture and foreign matter, becomes a paramount concern. It is also desirable that the protection hardware be relatively unobtrusive, without impairing its protective functionality.

SUMMARY OF THE INVENTION

In accordance with the present invention, the above objectives are successfully achieved by an external mounting architecture for an electronic lock, that includes a protective cover, which is normally pivotably biased against the front face of a support housing in which the electronic lock is installed, thereby protecting the lock against the introduction of moisture and foreign matter due to weather and the environment, but which is readily pivoted to an open, access position when it is desired to operate the lock by way of an electronic key therefor.

For this purpose, the lock mounting and protection architecture of the invention includes a generally conically configured housing having generally flat front and rear faces that are joined by a conical sidewall or collar. The conical configuration of the housing sidewall is generally sloped toward its front face, as in conventional lock structures, to prevent securely engaging a tool such as a wrench around the collar, and thereby protect against tampering. In addition the collar is sized to provide a spacer for extra length lock cylinders.

The rear face of the housing is mountable against a generally flat surface of a security access structure, such as a door or wall. The housing is sized to cover a bore formed in the security access structure, the bore accommodating a portion of an electronic lock, a front end of which is captured in a cavity of the housing. The cavity extends between the front and rear face of the housing and is configured so that a front, key access face portion of the electronic lock is coincident with the front face of the housing.

The rear face of the housing has an indented region sized for attachment of a pivot bracket. The pivot bracket includes a pair of hinge supports, having coaxial holes that receive a pivot shaft passing through associated holes in respective hinge flanges of a hinge plate of a pivotable front cover, that is sized to cover the front face of the housing. To accommodate the hinge plate, the housing's conical sidewall has a longitudinal slot that extends from the front face and intersects the indented region at the rear face of the housing. The hinge plate is configured to conform with the longitudinal slot and the conically curved surface of the housing sidewall, so that when the front cover is closed against the front face of the housing, the hinge plate readily fits within the longitudinal slot, and its outer surface is 'flush' with or coextensive with the outer surface of the housing sidewall.

The front cover has a generally flat cover plate, with a rear surface that conforms with the front face of the housing. A sidewall perimeter portion of the rear surface of the front cover captures a gasket to provide a weatherproof protective seal against the front face of the housing and the key access face of the electronic lock, when the cover plate is closed against the front face of the housing. A cover plate lip extends beneath the front face of the housing when the front cover is closed against the front face of the housing, and provides a grip for manually pivoting the cover about its pivot attachment with the pivot bracket.

A rearwardmost end portion of the hinge plate has a pair of hinge flanges that fit between the side portions of the pivot bracket, so that holes in the hinge plate are coaxial with holes through the side portions of the pivot bracket for receiving the pivot shaft. To enable the cover to freely rotate about the pivot bracket, but without contacting the outer surface of the structure to which the housing is mounted, the depth of the indented region and the size of the opposite side portions of the flat plate portion of the pivot bracket are such that the opposite side portions of the bracket are spaced apart from the rear face of the housing, when the rear face is mounted directly against a flat surface of a structure, such as a door or wall.

The rearwardmost end portion of the hinge plate is tapered in a curvilinear manner, so that as the hinge plate is rotated about the pivot shaft, the rearwardmost end portion of the hinge plate will clear the outer surface of the structure to which the housing is externally mounted. A helical bias spring is mounted on the pivot shaft between the hinge flanges, so as to normally bias the hinge plate into the longitudinal slot in the housing sidewall, thereby mechanically biasing the cover plate into a normally closed condition against the front face of the housing.

DETAILED DESCRIPTION

Figure 1:
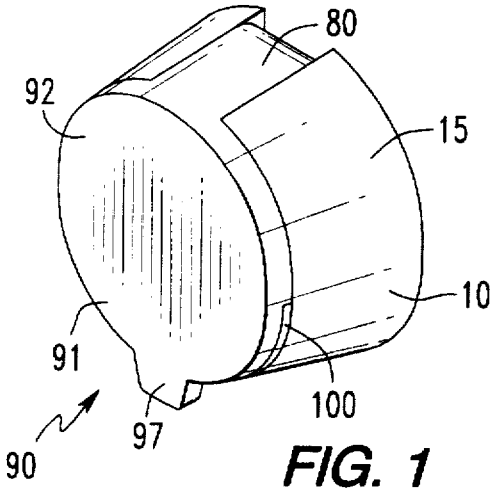
FIG. 1 is a diagrammatic perspective view of the external mounting architecture for an electronic lock in accordance with a preferred embodiment of the present invention, in which the front cover is closed over the face of the lock.
Figure 2:
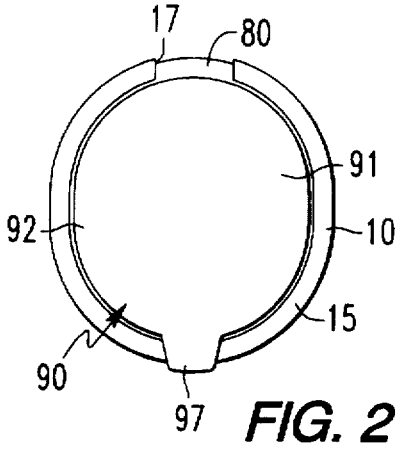
FIG. 2 is a diagrammatic front view of the lock-mounting architecture of the invention, in which the front cover is closed over the face of the lock.
Figure 3:
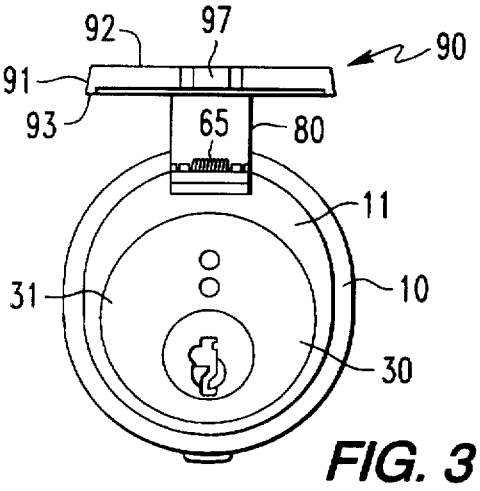
FIG. 3 is a diagrammatic front view of the lock-mounting architecture of the invention, in which the front cover is open, exposing the face of the lock.
Figure 4:
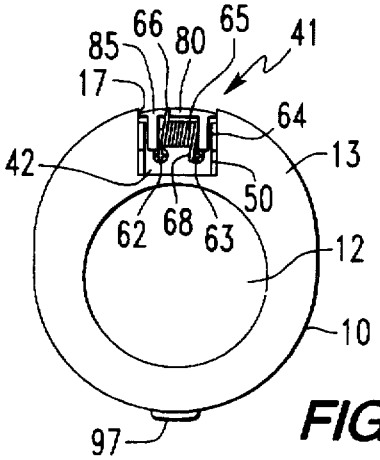
FIG. 4 is a diagrammatic rear view of the lock-mounting architecture of the invention, in which the front cover is closed.
Figure 5:
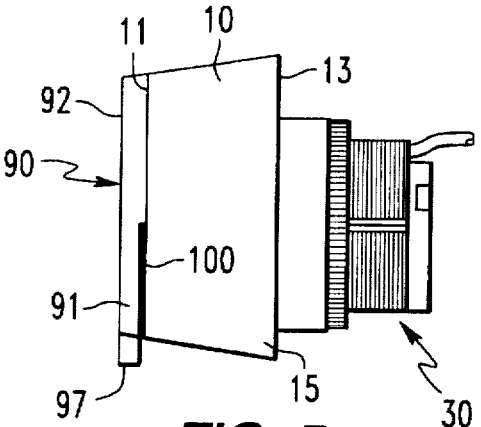
FIG. 5 is a diagrammatic side view of the lock-mounting architecture of the invention, in which the front cover is closed.

The external mounting architecture for an electronic lock in accordance with a preferred embodiment of the present invention will now be described with reference to FIGS. 1–19. As shown therein the mounting architecture includes a generally conically configured housing 10 having (generally flat or planar) front and rear faces 11 and 13, respectively, between which a sidewall 15 extends. In accordance with the generally conical configuration of housing 10, front face 11 has a smaller diameter than rear face 13, so that the housing sidewall 15 is generally sloped toward the front face 11, to prevent securely engaging a tool such as a wrench around the collar, and thereby protect against tampering. In addition, sidewall 15 may be of such a depth as to provide a spacer for extra length lock cylinders.

Housing 10 is preferably made of a structurally solid material, such as stainless steel, brass and the like, that is readily usable in either an indoor or an outdoor environment. The rear face 13 of housing 10 is sized to be mounted directly against the generally flat outer surface 21 of a security access structure 20, such as the exterior of a door, wall, etc., and to cover a generally cylindrical bore 23, that extends into the security access structure 20 from the outer surface 21 thereof. Bore 23 may be generally cylindrically configured and sized to accommodate a portion of a generally cylindrically configured electronic lock 30, of the type described in my U.S. Pat. No. 5,337,588, entitled: "Electronic Lock and Key System," assigned to the assignee of the present application and the disclosure of which is herein incorporated, as a non-limiting example. Alternatively, for a European type of lock configuration, as another non-limiting example, bore 23 is configured and sized to accommodate a portion of a Eurocylinder-shaped electronic lock, of the type described in my U.S. Pat. No. 5,507,162, entitled: "Eurocylinder-type Assembly for Electronic Lock and Key System," also assigned to the assignee of the present application and the disclosure of which is herein incorporated.

For externally mounting the electronic lock 30 to the security access structure 20, housing 10 further includes a bore or cavity 12 that extends between its front face 11 and its rear face 13. For installing a generally cylindrical electronic lock, such as of the type described in my above referenced U.S. Pat. No. 5,337,588, cavity 12 is generally cylindrical. For installing a Eurocylinder-shaped electronic lock, such as of the type described in my U.S. Pat. No. 5,507,162, cavity 12 is configured to conform with the modified shape of a Eurocylinder design. For purposes of the present description and illustration in the drawings, cavity 12 will be described as being generally cylindrical.

More particularly, for the present non-limiting example of use with a cylindrically configured lock, cavity 12 has a first circular recess 14 that intersects front face 11 of the housing and from which a cylindrical bore 16 extends to the rear face 13. The circular recess 14 of cavity 12 is sized to receive a circular key access face portion 31 of the electronic lock 30, such that the key access face portion 31 is generally coplanar with the front face 11 of the housing 10. Cylindrical bore 16 receives a reduced diameter cylindrical body portion of the electronic lock 30, which projects into the generally cylindrical bore 23 in the security access structure 20, when the rear face 13 of the housing is mounted flush against the outer surface 21 of structure 20.

The rear face 13 of the housing 10 has an indented region or pocket 41, which is sized to receive a pivot bracket 50. As shown in detail in FIGS. 15–17, pivot bracket 50 has a generally flat plate portion 51 containing bores 52 and 53, which are sized to receive respective mounting screws 62 and 63, that are threaded into corresponding threaded bores 72 and 73 in the rear surface 42 of the pocket 41. Opposite, circularly configured side portions 54 and 55 of flat plate portion 51 are bent around opposite edges 56 and 57 thereof, so as to form a pair of opposed hinge supports, having respective coaxial holes 58 and 59 therethrough. Holes 58 and 59 in the bent side portions of the flat plate portion 51 of pivot bracket 50 are sized to receive a pivot shaft 64, which passes through associated holes 81 and 82 in respective hinge flanges 83 and 84 of a hinge plate 80 of a pivotable front cover 90, as will be described.

In order to accommodate hinge plate 80, the sidewall 15 of housing 10 has a generally longitudinal slot 17 that extends from the front face 11 and intersects the indented region 41 at the rear face 13 of the housing. Hinge plate 80 is sized to generally conform with the size and shape of the longitudinal slot 17 and the conically curved surface of the housing sidewall 15, so that when a cover plate 91 of the front cover 90 is closed against the front face 11 of the housing 10, the hinge plate 80 is flush with the generally longitudinal slot 17, and its outer surface is effectively coextensive with the outer surface of the sidewall 15 of the housing 10.

The cover plate 91 of the front cover 90 is generally flat or planar configured, having generally flat outer and rear surfaces 92 and 93, respectively, The rear surface 93 is sized and shaped so as to generally conform with the size and shape of the front face 11 of the housing 10. In addition, a sidewall perimeter portion 94 of an upper portion 95 of the rear surface 93 of cover 90 has a groove 96, which receives a gasket 100, made of neoprene rubber or the like, and provides a weatherproof protective seal against the front face 11 of housing 10 and the key access face 31 of the electronic lock 30, when the cover plate 91 is closed against the front face 11 of the housing. Front cover 90 further includes a lip 97, diametrically opposed to the hinge plate 80, and extending beneath the front face 11 of the housing 11, when the cover plate 91 is closed against the front face 11 of the housing. Lip 97 provides a grip for manually pivoting the cover 90 about its pivot attachment with pivot bracket 50.

As pointed out above, the indented region 41 in the rear surface 13 of housing 10 is sized to receive a pivot bracket 50, to which the hinge plate 80 of the pivotable cover 90 is rotatably mounted. As shown in enlarged detail in FIGS. 4, 6, 11 and 12, a rearwardmost end portion 85 of hinge plate 80 has a pair of hinge flanges 83 and 84, which are sized and shaped to fit between and immediately adjacent to the bent side portions 54 and 55 of the flat plate portion 51 of the pivot bracket 50, so that respective holes 81 and 82 in the hinge plate 80 are coaxial with holes 58 and 59 through the bent side portions 54 and 55 of the pivot bracket 50, for receiving pivot shaft 64 therethrough.

Figure 6:
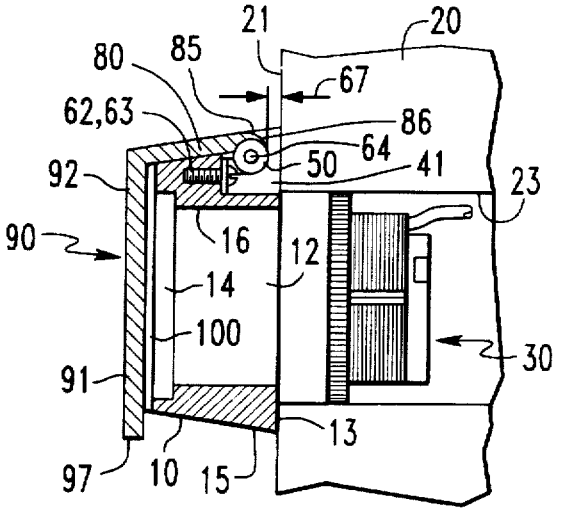
FIG. 6 is a diagrammatic side sectional view of the lock-mounting architecture of the invention, with the front cover closed, as mounted against a generally flat outer surface of a security access structure.
Figure 7:
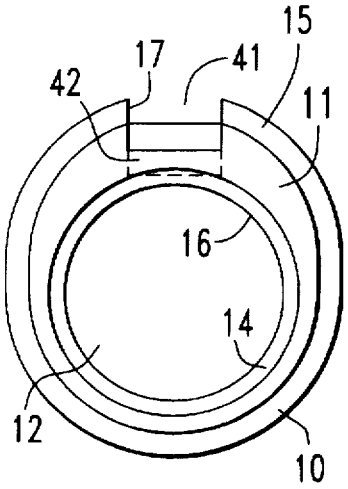
FIG. 7 is a diagrammatic front view of the generally conically configured housing of the lock-mounting architecture of the invention.
Figure 8:
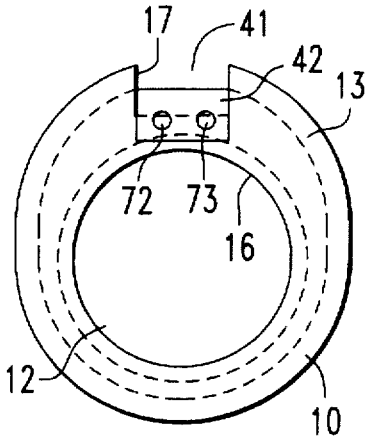
FIG. 8 is a diagrammatic rear view of the generally conically configured housing of FIG. 7.
Figure 9:
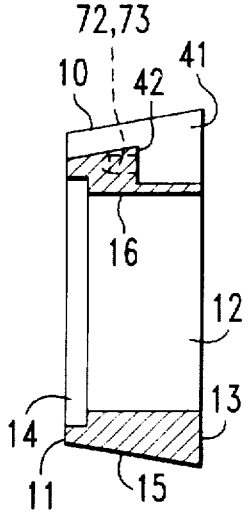
FIG. 9 is a diagrammatic side sectional view of the generally conically configured housing of FIG. 7.
Figure 10:
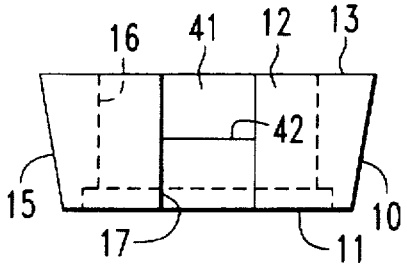
FIG. 10 is a diagrammatic top view of the generally conically configured housing of FIG. 7.
Figure 11:
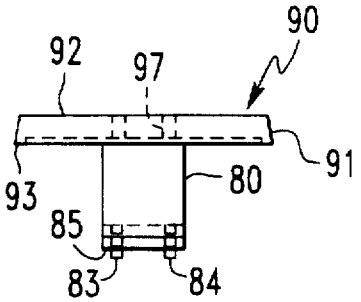
FIG. 11 is a diagrammatic top view of the pivotable cover employed in the lock-mounting architecture of the invention.
Figure 12:
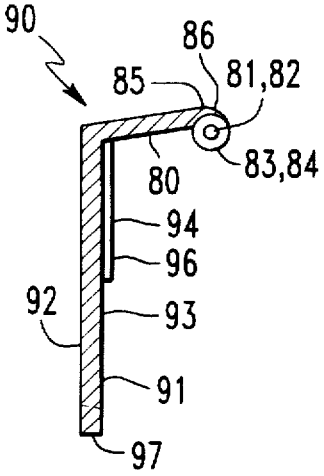
FIG. 12 is a diagrammatic side sectional view of the pivotable cover of FIG. 11.
Figure 13:
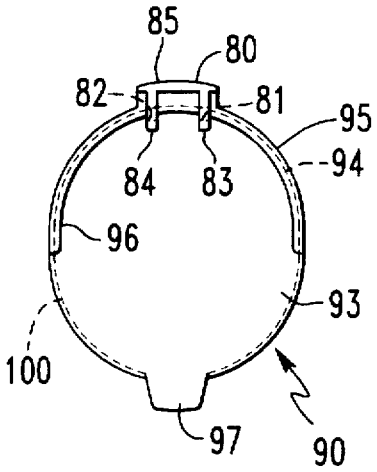
FIG. 13 is a diagrammatic rear view of the pivotable cover of FIG. 11.
Figure 14:
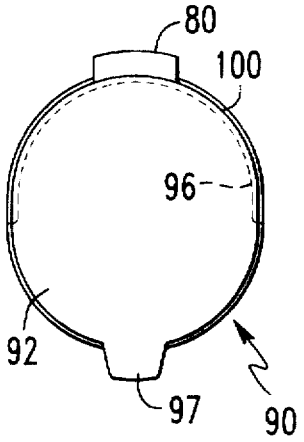
FIG. 14 is a diagrammatic front view of the pivotable cover of FIG. 11.
Figure 15:
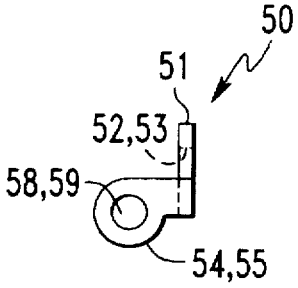
FIG. 15 is a diagrammatic side view of a pivot bracket employed in the lock-mounting architecture of the invention.
Figure 16:
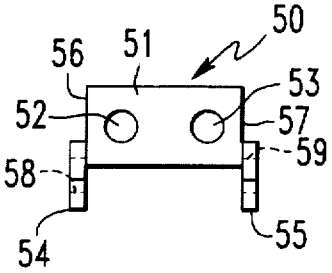
FIG. 16 is a diagrammatic front view of the pivot bracket of FIG. 15.
Figure 17:
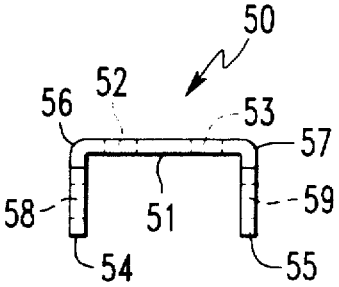
FIG. 17 is a diagrammatic top view of the pivot bracket of FIG. 15.
Figure 18:
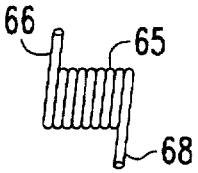
FIGS. 18 and 19 are respective side and end views of a bias spring.
Figure 19:
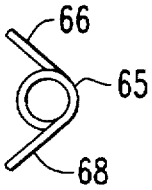

As shown in FIG. 6, in order to allow the cover 90 to freely rotate about pivot bracket 50, without contacting the outer surface 21 of the structure 20 against which the housing 10 is mounted, the depth of indented region 41 and the size of the opposite side portions 54 and 55 of theflat plate portion 51 of bracket 50 are such that the opposite side portions 54 and 55 of bracket 50 are spaced apart by a separation distance 67 from the rear face 13 of the housing 11, which is mounted flush against the outer surface 21 of the structure 20. In addition, as shown in FIGS. 6 and 12, the outer surface 86 of the rearwardmost end portion 85 of the hinge plate 80 is tapered in a curvilinear manner, so that as the hinge plate 80 is rotated about pivot shaft 64 the rearwardmost end portion 85 of the hinge plate 80 will clear outer surface 21 of the structure 20.

As pointed out above, the holes 58 and 59 in the bent side portions of the flat plate portion 51 of the cover's pivot bracket 50 are sized to receive a pivot shaft 64, which passes through associated holes 81 and 82 in respective hinge flanges 83 and 84 of the hinge plate 80 of pivotable front cover 90. Pivot shaft 64 receives a helical bias spring 65, which is retained between the hinge flanges 83 and 84. Respective ends 66 and 68 of bias spring 65 are urged against hinge plate 50 of cover 90 and the longitudinal slot 17 of housing 11, so as to normally bias the hinge plate 50 into the slot 17, thereby mechanically biasing the cover plate 91 into a normally closed condition against the front face 11 of the housing 10. Manually grasping the lip 97 at the bottom of the cover 90 to pivot the cover upwardly from its normally is closed condition against the front face 11 of the housing imparts a counter torque against the bias provided by the respective ends 66 and 68 of the spring 65. As a consequence, letting go of the lip 97 will cause the cover 90 to rotate about its pivot attachment with pivot bracket 50, and reclose the cover 90 to its normal weatherproof sealed condition.

As will be appreciated from the foregoing description, the external electronic lock mounting architecture of the present invention, which includes a protective cover normally pivotably biased against the front face of a support housing in which the electronic lock is installed, not only securely houses the lock, but protects the lock against the introduction of moisture and foreign matter due to weather and the environment. The integrated design of the pivotable protective cover with the lock housing makes the protection architecture relatively unobtrusive, without impairing its protective functionality, and readily allows the cover to be pivoted to an open, access position when it is desired to operate the lock by way of an electronic key.

While I have shown and described an embodiment in accordance with the present invention, it is to be understood that the same is not limited thereto but is susceptible to numerous changes and modifications as known to a person skilled in the art, and I therefore do not wish to be limited to the details shown and described herein, but intend to cover all such changes and modifications as are obvious to one of ordinary skill in the art.

What is claimed:

1. A protective architecture for an electronic lock having a key access face for receiving an electronic key, comprising a generally conically configured housing having front and rear faces joined by a conical sidewall, said rear face being mountable against a surface of a security access structure, said housing having a cavity configured to support therein said electronic lock, so that said key access face of said electronic lock is generally coincident with said front face of said housing, said rear face of said housing having an indented region to which a pivot bracket is affixed, said pivot bracket rotatably engaging a hinge plate of a pivotable front cover, which is sized to cover said front face of said housing, said conical sidewall having a slot that intersects said indented region, and wherein said hinge plate is configured to conform with said slot and said housing sidewall when said front cover is closed against said front face of said housing, and is configured such that, as said hinge plate is rotated about a pivot axis thereof, said hinge plate clears a structure to which said housing is externally mounted.

2. A protective architecture according to claim 1, wherein said front cover has a rear surface that conforms with said front face of said housing, and is configured to capture a gasket providing a protective seal against said front face of said housing and said key access face of said electronic lock, when said front cover is closed against said front face of said housing.

3. A protective architecture according to claim 2, wherein said hinge plate has a pair of hinge flanges that engage side portions of said pivot bracket, and have holes coaxial with holes through said side portions of the pivot bracket for receiving a pivot shaft about which said front cover rotates without said hinge plate contacting a structure against which said housing is mounted.

4. A protective architecture according to claim 3, wherein an end portion of said hinge plate is tapered so that as said hinge plate is rotated about said pivot shaft, said end portion of said hinge plate clears said outer surface of said structure to which said housing is externally mounted.

5. A protective architecture according to claim 4, further including a bias spring mounted to normally bias said hinge plate into said slot in said housing sidewall, thereby mechanically biasing said front cover into a normally closed condition against said front face of said housing.

6. A protective architecture for an electronic lock having a key access face and being adapted to be externally mounted to a support structure, said protective architecture comprising:

a housing having a front face, a rear face and a sidewall therebetween, and including a cavity, extending between said front face and said rear face, in which said electronic lock is installed, such that said key access face of said electronic lock is disposed adjacent to said front face of said housing, said rear face having an indented region, and said sidewall having a longitudinal slot that extends from said front face and intersects said indented region;

a cover closable over said front face of said housing and said key access face of said electronic lock; and a hinge plate that is integral with said cover, and is rotatable about a pivot attachment in said indented region, so as to be rotatable into and out of said longitudinal slot, said hinge plate being configured to fit into said longitudinal slot with its outer surface coextensive with and forming a portion of said sidewall of said housing as said cover is closed against said front face of said housing, and wherein, adjacent to said indented region, said hinge plate is shaped in a manner that prevents said hinge plate from engaging said support structure as said hinge plate is rotated about said pivot attachment.

7. A protective architecture according to claim 6, wherein said sidewall is sloped toward said front face so as to facilitate drainage of water away from said housing, thereby protecting internal components of said electronic lock.

8. A protective architecture according to claim 6, wherein said sidewall has a generally conical configuration that is sloped toward said front face so as to facilitate drainage of water away from said housing, thereby protecting internal components of said electronic lock.

9. A protective architecture according to claim 6, wherein said pivot attachment comprises a pivot bracket having a pair of hinge supports, containing holes that receive a pivot shaft passing through associated holes in respective flanges of said hinge plate.

10. A protective architecture according to claim 6, wherein said cover plate has a rear surface that conforms with said front face of said housing, and is configured to capture a gasket for providing a protective seal against said front face of said housing and said key access face of said electronic lock, when said cover plate is closed against said front face of said housing.

11. A protective architecture according to claim 6, wherein said cover plate has a lip that extends beneath said front face of said housing when said cover plate is closed against said front face of said housing, and provides a grip for manually pivoting said cover about said pivot bracket.

12. A protective architecture according to claim 6, further including a bias spring mounted at said intended region and normally biasing said hinge plate into said longitudinal slot in said sidewall, and thereby mechanically biasing said cover plate into a normally closed condition against said front face of said housing.

* * * * *